US005106635A

United States Patent [19]

McCutchan et al.

[11] Patent Number: 5,106,635

[45] Date of Patent: Apr. 21, 1992

[54] METHOD OF SIMULTANEOUSLY MICROWAVE HEATING OR BAKING PLURAL ARTICLES, AND CONCOMITANT PACKAGE

[75] Inventors: Michael D. McCutchan, Hamilton; Steve G. Fishter, Harrison; Deborah J. Yee, Cincinnati, all of Ohio

[73] Assignee: The Procter & Gamble Company, Cincinnati, Ohio

[21] Appl. No.: 437,001

[22] Filed: Nov. 15, 1989

[51] Int. Cl.[5] ..... B65D 85/00

[52] U.S. Cl. ..... 426/107; 219/10.55 E; 426/113; 426/124; 426/128; 426/234; 426/243

[58] Field of Search ..... 426/113, 107, 234, 243, 426/124, 112, 128; 219/10.55 E

[56] References Cited

U.S. PATENT DOCUMENTS

| | | | |
|---|---|---|---|
| 3,874,548 | 4/1975 | Buff, Jr. | 426/113 |
| 4,413,167 | 11/1983 | Martel et al. | 219/10.55 E |
| 4,416,906 | 11/1983 | Watkins | 426/107 |
| 4,416,907 | 11/1983 | Watkins | 426/234 |
| 4,486,640 | 12/1984 | Bowen et al. | 219/10.55 E |
| 4,567,341 | 1/1986 | Brown | 426/113 |
| 4,641,005 | 2/1987 | Seiferth | 219/10.55 E |
| 4,825,024 | 4/1989 | Seaborne | 219/10.55 E |
| 4,825,025 | 4/1989 | Seiferth | 219/10.55 E |
| 4,853,509 | 8/1989 | Murakami | 219/10.55 E |
| 4,874,620 | 10/1989 | Mendenhall et al. | 426/111 |
| 4,876,428 | 10/1989 | Petcavich | 426/243 |
| 4,916,280 | 4/1990 | Havette | 426/107 |

OTHER PUBLICATIONS

"Sophisticated Microwave", Gifts and Decorative Accessories, Apr. 1978, p. 94.

*Primary Examiner*—Donald E. Czaja
*Assistant Examiner*—Anthony Weier
*Attorney, Agent, or Firm*—Michael E. Hilton; E. Kelly Linman; Richard C. Witte

[57] ABSTRACT

A method and package for simultaneously microwave heating or baking a plurality of articles such as brownies, cupcakes, muffins or cookies or the like. The method includes the steps of arranging the plurality of articles in a predetermined, vacant-center array within an ovenable container, non-sealingly enclosing the array of articles in the container so that the articles share a common headspace, and applying microwave energy for a sufficient period of time to effect the heating or baking. The method may further include preparing a bakeable batter, subdividing the batter into a plurality of equal portions with one portion in each of a plurality of like receptacles so that, upon being baked, each of the portions becomes one of the articles. A package is also provided to facilitate practicing the method. A preferred package comprises a mix for preparing a bakeable batter, a plurality of receptacles into which the batter may be subdivided, and a container which is sized and configured to accommodate a vacant center array of articles or batter laden receptacles, and to provide a common headspace above the articles. The package may also include selectively patterned and/or positioned microwave susceptors or reflective materials to further ensure uniform heating or baking of the articles.

34 Claims, 2 Drawing Sheets

Fig. 1

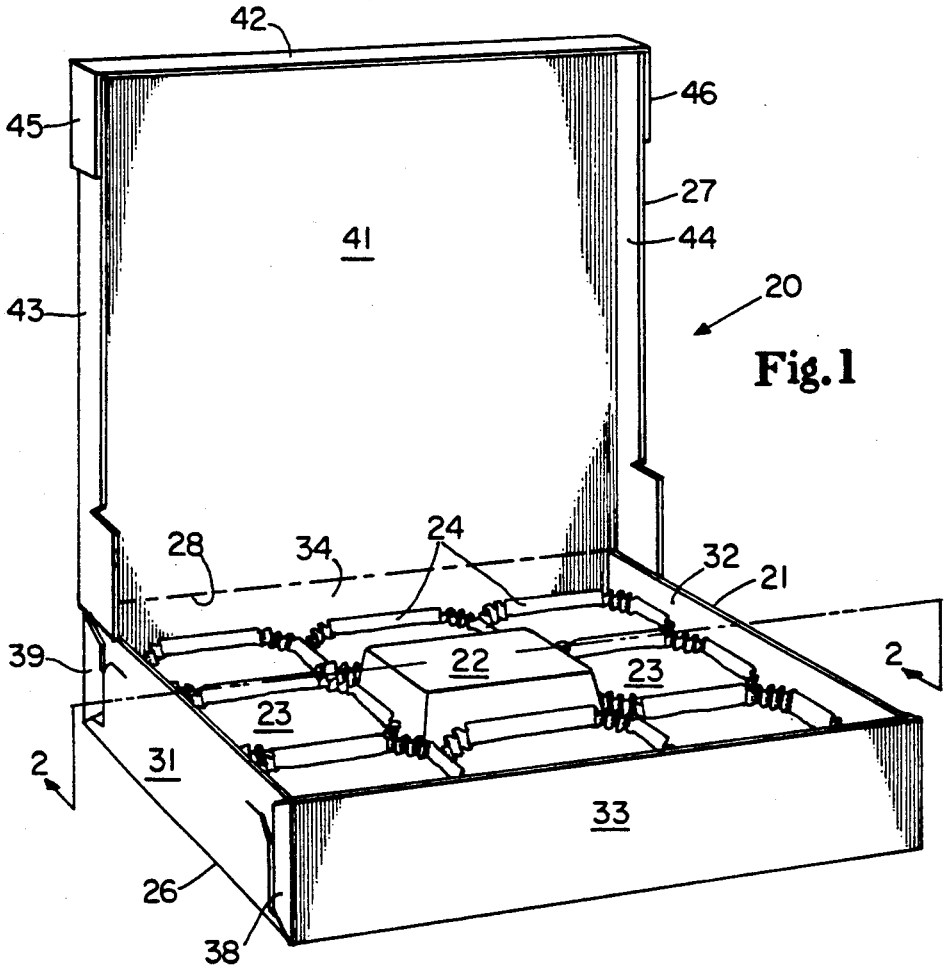
Fig. 1
Fig. 2
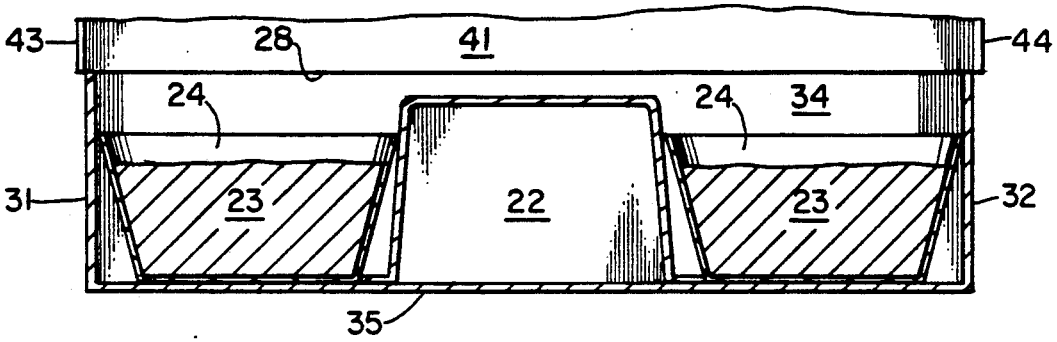

METHOD OF SIMULTANEOUSLY MICROWAVE HEATING OR BAKING PLURAL ARTICLES, AND CONCOMITANT PACKAGE

TECHNICAL FIELD

The invention pertains to a method, and concomitant products, for simultaneously and substantially uniformly heating or baking a plurality of like articles such as, for example, cookies, cupcakes, muffins, brownies, or other items in a microwave oven. The term "heating" is used herein in a generic sense to include heating per se to simply increase temperature; and to include cooking—e.g., baking—to effect temperature rise as well as chemical modification. Accordingly, heating would be applicable for, for example, a package of frozen, pre-cooked articles; and baking would be applicable for, for example, products comprising a batter mix which would be mixed by a consumer to form a bakeable batter, and subdivided into a plurality of receptacles such as paper cupcake cups.

BACKGROUND OF THE INVENTION

Packages which contain plural food items and which packages enable heating or cooking the food items in microwave ovens without removing the contents therefrom are shown, for instance, in U.S. Pat. No. 4,825,024 which issued Apr. 25, 1989 to Jonathan Seaborne. In the packages shown, four like food items are disposed in a two-by-two orthogonal array. Such packages can comprise a microwave heating susceptor fabricated into trays, dishes or shallow pans in various configurations, and may include a cover of susceptor material.

An annular-shape microwave food heating container is disclosed in U.S. Pat. No. 4,416,906, and a related process for preparing food packages for microwave heating is disclosed in U.S. Pat. No. 4,416,907 which patents issued Nov. 22, 1983 to James D. Watkins.

A rice cooker for microwave ranges is disclosed in U.S. Pat. No. 4,853,509 which issued Aug. 1, 1989 to Tatsuo Murakami. This cooker enables preparation of a plurality of rice balls in separate confined spaces which are disposed about a centrally disposed tube through which water is supplied.

A cooker/baker utensil for microwave oven is disclosed in U.S. Pat. No. 4,486,640 which issued Dec. 4, 1984 to Robert F. Bowen, et al. This utensil comprises a tray and cover which are metallic, and which shield the interior thereof from microwave energy. The tray, as shown in the figures, is subdivided into plural pie-shape compartments.

A microwave egg cooker is disclosed in U.S. Pat. No. 4,413,167 which issued Nov. 1, 1983 to Thomas J. Martel, et al. Essentially, this is a double boiler type cooker wherein a metal lid and a metal tray substantially shield eggs disposed in the tray from direct microwave heating; and water is boiled in a microwave transparent bottom container to effect sufficient heating to cook the eggs. As shown in FIG. 4 of Martel et al., the tray is provided with an array of four round receptacles.

Food receptacles and laminates for microwave cooking which comprise vapor deposited microwave susceptors are disclosed in U.S. Pat. Nos. 4,641,005 and 4,825,025 which issued to Oscar E. Seiferth on Feb. 3, 1987 and Apr. 25, 1989, respectively.

SUMMARY OF THE INVENTION

In one aspect of the invention, a method is provided for simultaneously microwave heating or baking a plurality of articles which method comprises the steps of arranging the plurality of articles in a predetermined array within an ovenable container, non-sealingly enclosing the array of articles in the container so the articles share a common headspace in the container, and applying microwave energy for a sufficient period of time to effect the desired degree of heating or baking. Exemplary articles include brownies, cupcakes, and muffins. The predetermined array is preferably so configured to have a centrally disposed vacant zone and so that each article has plural other said articles in side-by-side adjacent relation. In a preferred embodiment, the array is a 3-by-3 orthogonal configuration, each of the articles is in side-by-side adjacent relation with two other articles, and the predetermined plurality is eight. The method may further comprise preparing a bakeable batter, subdividing the batter into a plurality of equal portions with one portion in each of a plurality of like receptacles so that, upon being baked, each of the portions becomes one of the articles. A package is also provided to facilitate practicing the method. A preferred package comprises a mix for preparing a bakeable batter, a plurality of receptacles into which the batter may be subdivided, and a container such as a carton which is sized and configured to accommodate an array of articles or batter-laden receptacles, and to provide a common headspace above the articles or receptacles. The container comprises a cover which can be closed to enable heating the headspace, but which does not seal the container whereby pressurization of the container during baking is obviated. In other aspects of the invention, the receptacles and/or the container may be provided with microwave susceptors and/or microwave reflective material to further ensure uniform baking of the plurality of articles. But for optionally including strategically disposed microwave susceptor means—e.g., coatings or elements—the container is preferably substantially microwave transparent: for example cartonboard from which folding cartons are commonly made. And, in additional aspects of the invention, the package may comprise an ovenable container such as a carton, and a plurality of comestible articles which are, when packaged, disposed in a predetermined, vacant-center array within the container, and which container comprises closure means for providing a common, unsealed headspace above the articles.

BRIEF DESCRIPTIONS OF THE DRAWINGS

While the specification concludes with claims that particularly point out and distinctly claim the subject matter regarded as forming the present invention, it is believed that the invention will be better understood from the following detailed description with reference to the drawings in which identical features or elements in the several views are identically designated and in which:

FIG. 1 is a perspective view of a package embodiment of the invention.

FIG. 2 is a fragmentary sectional view taken along section line 2—2 of FIG. 1.

DETAILED DESCRIPTION OF THE INVENTION

Figure 3:
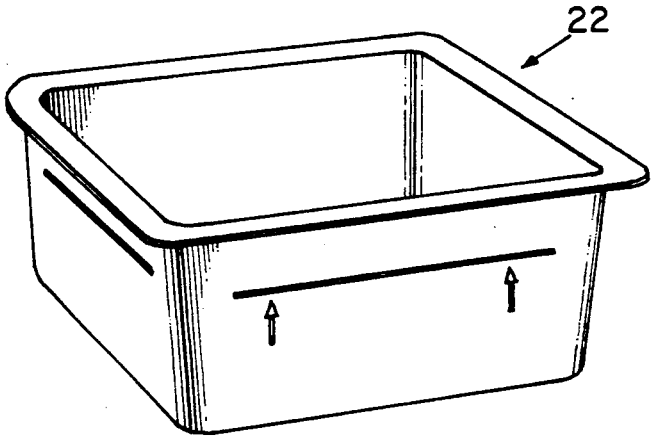
FIG. 3 is a perspective, enlarged scale view of a microwave transparent, measuring cup such as is shown in the central zone of the package of in FIG. 1.

An exemplary packaged food product 20 for practicing the method of the present invention is shown in FIG. 1 to comprise a container or carton 21, spacer means 22, eight (8) articles 23 which are to be heated or baked within the container, when closed and when placed in a microwave oven. Each article 23 is disposed in a receptacle 24 such as, for example, a paper cupcake cup. Such an embodiment is useful, for instance, for baking brownies.

The present invention provides a method and concomitant packages for simultaneously heating or baking a plurality of articles: for example comestible articles. Inasmuch as currently preferred package embodiments comprise batter mixes, and entail baking, the remainder of the specification refers primarily to baking articles. It is, however, clearly intended to include other manifestations of microwave heating and cooking of articles within the scope of the invention: for example, heating of pre-baked (wholly or partially) brownies, cupcakes, muffins, and cookies and the like which may be marketed in refrigerated or frozen or shelf stable states.

Basically, a plurality of articles to be baked are arranged in a predetermined array within a container. The predetermined array is configured to have a centrally disposed vacant zone. A preferred array is shown in FIG. 1 to have a 3-by-3 orthogonal configuration, with the center position devoid of a bakeable article. The array is enclosed within a container or carton which is sized to provide a common headspace over the articles. The container is further configured to avoid pressurization thereof during article baking. This is preferably accomplished by venting the container by means disposed remote from the headspace. The combination of the closed headspace and the open-center array is effective for uniformly baking the articles. Uniform baking, of some products, may be enhanced by the use of microwave susceptors as is more fully delineated hereafter.

Referring again to FIG. 1, carton 21 is shown to have a unitary construction, and to comprise a bottom section 26 and a top or cover section 27 which sections are integrally hinged along line 28. Bottom section 26 comprises integral side walls 31 and 32, a front wall 33, a back wall 34, and (as shown in FIG. 2) a bottom wall 35. Tabs 38 and 39 are shown fitted into slits in sidewall 31 for holding the sidewalls in the erected position, albeit this is not intended to exclude other carton configurations (e.g., glued tabs) from the present invention.

Top or cover section 27, FIG. 1, of carton 21 is shown to comprise top panel 41, front skirt 42, side skirts 43 and 44, and glued tabs 45 and 46. The top section 27 is sized, relative to the bottom section, so that the skirts 42, 43 and 44 are outside the walls 31, 32 and 33 of the bottom section 26 when the cover 27 is closed. A close fit between the skirts 42 through 44 and the walls 31 through 33, and their overlapping configurations provide means or passageways for the interior of carton 21 to be indirectly vented about lower perimetrical portions of carton 21 when closed. Carton 21 has an interior height that is greater than the heights of receptacles 24. This provides a closed headspace within carton 21, when closed. Air disposed in the closed headspace is heated convectively by heat generated within the articles 23 due to the articles 23 converting microwave energy to heat. Thus, the air in the headspace becomes a uniformly heated and moisture laden blanket during baking of articles 23, and this contributes to evenly baking the articles by enabling heat generated by one of the articles to be transferred to cooler articles.

Carton 21, FIG. 1, may be made from folding carton cartonboard of suitable basis weight. An exemplary square carton for a brownies package has a length and width of about eight inches (about 20.3 cm) and a height of about one-and-one-quarter inches (about 3.2 cm) may be made from about 20 point cartonboard. Since the cartonboard is microwave transparent, the enclosure or carton 21 permits a significant portion of an external field of microwave energy to impinge directly upon the articles 23. Additionally, for some articles, the cartonboard may be coated with a moisture barrier material. Such a coating on the interior surface of a carton for baking comestible articles has been found to be effective for achieving smoother top surfaces on the baked articles, and for maintaining freshness if the baked articles are stored in the carton. Such cartons having a height of about one-and-three-quarter inches (about 4.4 cm) are preferred for packages wherein the cupcake cups are about one-and-one-eighth inches (about 2.9 cm) high: for example, for cupcakes, and muffins.

An exemplary spacer means 22 is, as shown in FIG. 3, a microwave transparent, thermoplastic measuring cup 22. In packages comprising a dry mix to which water or milk is added to make a batter, the measuring cup 22 is used to measure the correct amount of liquid. Then, the measuring cup is inverted and placed in the center of carton 21, and the eight batter-filled receptacles are positioned about the cup. Thus, the cup 22 functions as a spacer in the configuration shown in FIG. 1. While a cup/spacer 22 has been included in FIG. 1, and in this description, it is not intended that it be an essential element. Its use facilitates formation of an open-center array as described above; but its use is not believed to be mandatory. Articles 23, FIG. 1, may be portions of such bakeable batters which, when baked, become brownies, muffins, or cupcakes. Inasmuch as such articles generally rise when baked, the receptacles 24 are shown in FIGS. 1 and 2 to be less than full. The receptacles are filled to from about one-third full to about four-fifths full to allow for rising: typically about one-half full. Alternatively, articles 23 may be pre-formed articles which may be partially or wholly pre-cooked or pre-baked, and which may be marketed in refrigerated or frozen packages: ready for microwave heating.

Receptacles 24, FIG. may, for example, be made of paper. Indeed, they may be paper cupcake cups. Additionally, for some articles, the receptacles may comprise microwave susceptor materials: for example, a thin layer of vapor deposited aluminum. Such susceptor-type receptacles have been found to be especially useful with respect to microwave muffin mixes, and cupcakes. Exemplary cups 24 have heights of about seven-eights of an inch (about 2.2 cm) to about one-and-one-eighth inches (about 2.9 cm).

As used herein, the term cupcake cup is intended to be generic: to refer generally to cups made from sheet material, and which commonly have accordion folds around their side walls. Such cups are commonly made from paper but it is not intended to thereby limit the present invention.

A preferred package 20 which comprises the elements to practice the present method invention comprises a substantially microwave transparent carton, a dry mix to which water or milk may be added to form a batter, eight paper cupcake cups, and a microwave transparent cup for measuring the required amount of liquid to make the batter. The package may also include sufficient frosting, icing or other topping. In use; the batter is prepared and subdivided into the cupcake cups; the batter-filled cups are arranged as shown in FIG. 1; the measuring cup is inverted and placed in the center of the array as shown in FIG. 1; and the cover is closed. The package, thus arranged, is then placed in a microwave oven where microwave energy directly impinges upon the articles for a sufficient time to effect the desired degree of baking. In this baking position, the measuring cup has a top plan view about equal to the top plan view size of a receptacle.

For such a package comprising a brownie mix, the carton may comprise a coating of moisture barrier material: preferably on the inner surface of the carton. This has been found to be effective for achieving smoother top surfaces, and for maintaining freshness when the brownies, after being baked, are stored in the container.

An alternate package which is preferred for embodiments comprising muffin mixes, and cupcake/snack cake mixes comprises the moisture barrier coated carton described above, and further includes having susceptor-type cupcake cups: e.g., paper cupcake cups which are lined with thermoplastic covered, vacuum deposited aluminum.

Additional alternate embodiments may be provided by having a microwave susceptor atop the bottom wall of the carton. This may be provided by incorporating susceptor material in the bottom wall per se, or by providing a discrete susceptor panel as described above. Such bottom disposed susceptors have been found to contribute to uniform baking by, it is believed, slowing down the baking. Such susceptors may cover substantially the entire extent of the bottom wall of the carton or may have holes in their centers. Additionally, they may be corrugated as well as planar. Additionally, microwave susceptor or reflective material may be provided on the interior side of the cover and/or sides of the carton. Susceptors may, for example, be vapor deposited aluminum on a plastic film which is laminated to the carton board; or a discrete susceptor panel may be adhered to the interior side of the top panel. An exemplary reflective material is aluminum foil. Such use of susceptors and/or reflective materials in such packages have been found to contribute to the uniformity of heating the air in the common headspace, and to thereby contribute to uniformity of baking of the articles.

Figure 4:
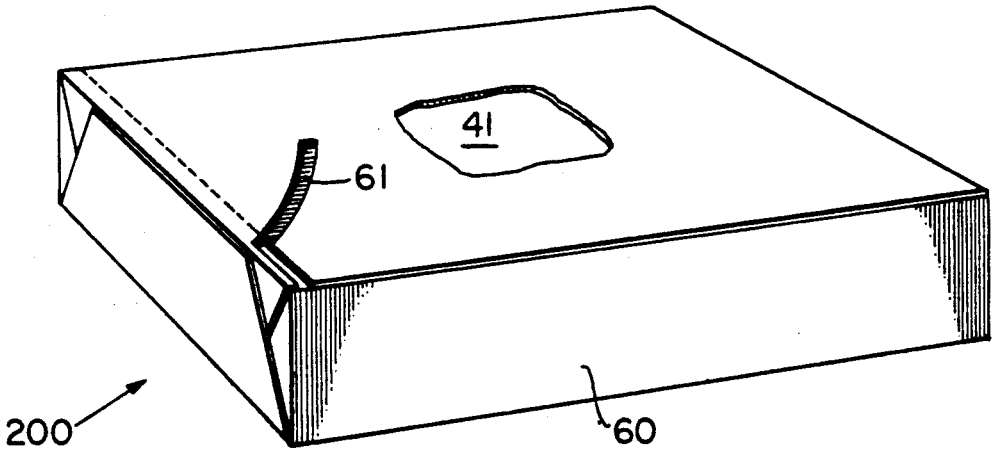
FIG. 4 is a perspective view of a package having a tear open starter strip partially pulled up, and which package comprises elements which may be arranged in the dispositions shown in FIG. 1.

Referring now to FIG. 4, a product 200 is shown in perspective. Product 200 comprises an overwrap 60 about a product such as product 20, FIG. 1. Overwrap 60 is fitted with a pull tab 61 for tear-opening the product to gain access to a package embodiment of the present invention such as package 20, FIG. 1. Package 20 per se is not shown in FIG. 4, but a fragmentary portion of overwrap 60 has been removed to expose a portion of the top panel 41 of carton 21. Essentially, inasmuch as container 21 is not sealed, an overwrap such as overwrap 60 may be applied to protect against intrusion of dust, dirt, or insects and the like during storage, shipping, and display periods. Additionally, because it is preferred that container 21 not have inks and the like applied to its surface to obviate contamination during baking, overwrap 60 provides surfaces which may be used for identification, trademarks, advertising, and instructions and the like. Alternative protective covers such as sleeves may, of course be used. Additionally, albeit covers and overwraps are discussed herein, it is not intended to thereby limit the present invention.

While particular embodiments of the present invention have been illustrated and described, it would be obvious to those skilled in the art that various other changes and modifications can be made without departing from the spirit and scope of the invention. It is intended to cover in the appended claims all such changes and modifications that are within the scope of this invention.

What is claimed is:

1. A method of simultaneously, uniformly microwave heating a plurality of like articles which are susceptible to being heated by converting microwave energy which directly impinges upon said articles to heat, said method comprising the steps of:

(a) arranging said plurality of like articles in an array having a centrally disposed vacant zone;

(b) enclosing said array and, incident to said enclosing, providing a common, unsealed headspace superjacent said articles such that heat generated by one of said articles can be transferred to cooler said articles via said common headspace, said enclosing being effected by enclosure means which are substantially transparent to microwave energy such that a significant portion of an external field of microwave energy may directly impinge upon said articles; and (c) applying a field of microwave energy to said enclosure means such that a significant portion of the field of microwave energy directly impinges upon said articles through said enclosure means and is converted to heat within said articles until said articles are heated to a predetermined degree.

2. The method of claim 1 wherein each of said articles is disposed in a receptacle comprising microwave susceptor means for partially heating said articles by heat generated within the susceptors and conducted or radiated into said articles, and for partially shielding said articles from direct microwave impingement.

3. The method of claim 1 wherein said plurality of like articles are provided by the further steps of:

(a) preparing a bakeable batter; and (b) sub-dividing said batter into a plurality of substantially equal portions, and placing each of said portions in one of a plurality of receptacles.

4. The method of claim 3 wherein said receptacles comprise microwave susceptor means for partially heating said articles by heat generated within the susceptors and conducted or radiated into said articles, and for partially shielding said articles from direct microwave impingement.

5. The method of claim 1 or 3 wherein said unsealed common headspace is unsealed by virtue of said method comprising the step of venting said headspace remotely from said headspace.

6. The method of claim 1 or 3 further comprising the step of augmenting heating of said common headspace by providing microwave susceptor means adjacent said common headspace.

7. The method of claim 6 wherein said microwave susceptor means is devoid of susceptor material in its central region disposed superjacent said vacant zone of said array.

8. The method of claim 1 or 3 further comprising the step of augmenting heating of said articles by providing microwave susceptor means subjacent said articles.

9. The method of claim 8 wherein said microwave susceptor means is devoid of susceptor material in its central region disposed subjacent said vacant zone of said array.

10. The method of claim 1 or 3 wherein said array is a 3-by-3 orthogonal configuration having a vacant center position.

11. The method of claim 1 or 3 wherein said array has an annular, vacant-center configuration.

12. A packaged food product suitable for simultaneously microwave oven heating a plurality of like articles contained therein which articles are susceptible to being heated by converting microwave energy which directly impinges upon said articles to heat, said product comprising a container which is transparent to microwave energy such that a significant portion of an external field of microwave energy may directly impinge upon said articles, and a plurality of like said articles capable of converting microwave energy which impinges upon said articles to heat within said articles, said container including means for being closed but unsealed during said heating, said container and said articles being relatively sized and configured to provide a common closed headspace during said heating such that heat generated by one of said articles can be transferred to cooler said articles via said common headspace, said articles being arranged in a predetermined array having a centrally disposed vacant zone, and said array being so configured that each said article has plural other said articles in side-by-side adjacent relation.

13. The packaged food product of claim 12 wherein said articles are brownies.

14. The packaged food product of claim 12 wherein said articles are cupcakes.

15. The packaged food product of claim 12 wherein said articles are muffins.

16. The packaged food product of claim 12 wherein said articles are cookies.

17. The packaged food product of claim 12 wherein said container comprises means for indirectly venting said closed headspace.

18. The packaged food product of claim 12 wherein each said article is disposed in a receptacle, and said receptacle comprises microwave susceptor means.

19. The packaged food product of claim 12 wherein said container comprises microwave susceptor means disposed adjacent said common headspace.

20. The packaged food product of claim 12 wherein said container comprises microwave susceptor means disposed subjacent said articles.

21. The packaged food product of claim 12, 13, 14, 15, or 16 wherein said plurality numbers eight, and wherein said array has a 3-by-3 orthogonal configuration with the center position not occupied by a said article.

22. A packaged food product suitable for simultaneously microwave oven baking a predetermined plurality of bakeable comestible articles which are susceptible to being heated by converting microwave energy which impinges upon said articles to heat within said articles, said product comprising a container which is transparent to microwave energy such that a significant portion of an external field of microwave energy may directly impinge upon said articles and having means for being closed but unsealed during said baking, a plurality of like receptacles, and a batter mix, said batter mix being susceptible to becoming a bakeable comestible batter and to being subdivided into plural equal portions with one of said equal portions disposed in each of said receptacles, said portions being capable of converting microwave energy which impinges thereon to heat within said portions, said receptacles and said enclosure being sized and configured to provide a common closed headspace during said baking such that heat generated by one of said portions can be transferred to cooler said portions via said common headspace, and to enable having said receptacles arranged therein in a predetermined array during said baking, said array having a centrally disposed vacant zone and being so configured that each of said receptacles has plural other said receptacles in side-by-side adjacent relation, said vacant zone being about equal in size to the region of said container that is occupied by each of said receptacles.

23. The packaged food product of claim 22 wherein said substantially vacant zone is defined by a substantially microwave transparent spacer member having a top plan-view size when inverted and surrounded by receptacles for baking about equal to the top plan-view size of a said receptacle.

24. The packaged food product of claim 22 wherein said mix is a brownie mix.

25. The packaged food product of claim 22 wherein said mix is a cupcake mix.

26. The packaged food product of claim 22 wherein said mix is a muffin mix.

27. The packaged food product of claim 22 wherein said mix is a cookie mix.

28. The packaged food product of claim 22 wherein said container comprises means for indirectly venting said closed headspace.

29. The packaged food product of claim 22 wherein said receptacle comprises microwave susceptor means.

30. The packaged food product of claim 22 wherein said container comprises microwave susceptor means disposed adjacent said common headspace.

31. The packaged food product of claim 22 wherein said enclosure comprises microwave susceptor means disposed subjacent said articles.

32. The packaged food product of claim 22, 24, 25, 26 or 27 wherein said plurality numbers eight, and wherein said array has a 3-by-3 orthogonal configuration with the center position not occupied by a said article.

33. The packaged food product of claim 12 or 22 wherein said container comprises cartonboard, and said cartonboard is coated with moisture barrier material.

34. The packaged food product of claim 33 wherein said moisture barrier material is disposed on the surface of said cartonboard which faces the interior of said container.

* * * * *